US010323629B2

(12) United States Patent
Heilingloh et al.

(10) Patent No.: US 10,323,629 B2
(45) Date of Patent: Jun. 18, 2019

(54) MULTI-STAGE PISTON COMPRESSOR HAVING AN OUTER COOLING AIR CONDUCTION SYSTEM

(71) Applicant: KNORR-BREMSE Systeme fuer Schienenfahrzeuge GmbH, Munich (DE)

(72) Inventors: Melanie Heilingloh, Meeder (DE); Matthias Fritz, Erfurt (DE); Simon Froehlich, Munich (DE); Armin Leberfinger, Kuenzing (DE)

(73) Assignee: KNORR-BREMSE Systeme fuer Nuttzfahrzeuge GmbH, Munich (DE)

( * ) Notice: Subject to any disclaimer, the term of this patent is extended or adjusted under 35 U.S.C. 154(b) by 141 days.

(21) Appl. No.: 15/462,060

(22) Filed: Mar. 17, 2017

(65) Prior Publication Data

US 2017/0184087 A1 Jun. 29, 2017

Related U.S. Application Data

(63) Continuation of application No. PCT/EP2015/069580, filed on Aug. 27, 2015.

(30) Foreign Application Priority Data

Sep. 19, 2014 (DE) ..... 10 2014 113 598

(51) Int. Cl.
*F01B 31/08* (2006.01)
*F04B 39/06* (2006.01)
(Continued)

(52) U.S. Cl.
CPC ..... *F04B 39/066* (2013.01); *F04B 25/005* (2013.01); *F04B 27/005* (2013.01);
(Continued)

(58) Field of Classification Search
CPC ..... F04B 39/064; F04B 39/066; F04B 53/08
See application file for complete search history.

(56) References Cited

U.S. PATENT DOCUMENTS 2,899,130 A * 8/1959 Sykes ..... F04B 39/066 417/234
4,190,402 A 2/1980 Meece et al.
(Continued)

FOREIGN PATENT DOCUMENTS

DE 26 19 561 A1 11/1976
DE 199 08 308 A1 8/2000
(Continued)

OTHER PUBLICATIONS

International Preliminary Report on Patentability (PCT/IB/326, PCT/IB/338 & PCT/IB/373) issued in PCT Application No. PCT/EP2015/069580 dated Mar. 30, 2017, including English translation of document C2 (German-language Written Opinion (PCT/ISA/237)) previously filed on Mar. 17, 2017 (10 pages).
(Continued)

*Primary Examiner* — Michael Leslie
(74) *Attorney, Agent, or Firm* — Crowell & Moring LLP

(57) ABSTRACT

A multi-stage piston compressor with a cooling arrangement is provided. The multi-stage piston compressor includes a compressor unit having a plurality of air-cooled cylinders on a crankcase housing, a motor unit that is mounted at an end face of the crankcase housing, and a cooler unit at an opposing end face of the compressor unit. An axial fan wheel of the cooler unit blows cooling air substantially outwards toward the compressor unit. In order to conduct cooling air externally in the region of said compressor unit, at least one air guide housing mounted between the cooler unit and the crankcase extends at least partially radially around the crankcase in a curved manner, such that the axial air flow generated by the axial fan wheel is at least partially
(Continued)

guided around the crankcase in the radial direction and toward at least one cylinder at the air outlet side of the air guide housing.

12 Claims, 4 Drawing Sheets

(51) Int. Cl.

| | |
|---|---|
| ***F04B 25/00*** | (2006.01) |
| ***F04B 27/00*** | (2006.01) |
| ***F04B 27/02*** | (2006.01) |
| ***F04B 53/08*** | (2006.01) |
| ***F04B 53/00*** | (2006.01) |

(52) U.S. Cl.
CPC ..... *F04B 27/02* (2013.01); *F04B 39/064* (2013.01); *F04B 53/002* (2013.01); *F04B 53/08* (2013.01)

(56) References Cited

U.S. PATENT DOCUMENTS

| | | | | |
|---|---|---|---|---|
| 4,915,594 | A | 4/1990 | Lammers | |
| 5,020,973 | A * | 6/1991 | Lammers | F04B 39/066 417/243 |
| 5,584,675 | A * | 12/1996 | Steurer | F04B 39/066 417/372 |
| 6,364,632 | B1 | 4/2002 | Cromm et al. | |
| 8,430,650 | B2 * | 4/2013 | Ohata | F04B 39/0016 92/240 |
| 8,992,187 | B2 * | 3/2015 | Hartl | F04B 39/066 417/368 |
| 9,022,068 | B2 * | 5/2015 | Achatz | F04B 39/066 417/53 |
| 2009/0151794 | A1 | 6/2009 | Achatz et al. | |
| 2010/0054958 | A1 | 3/2010 | Hartl et al. | |
| 2013/0064689 | A1 | 3/2013 | White et al. | |
| 2013/0108487 | A1 | 5/2013 | Hartl et al. | |

FOREIGN PATENT DOCUMENTS

| | | | |
|---|---|---|---|
| DE | 10 2005 053 949 | B3 | 11/2006 |
| DE | 10 2007 019 126 | A1 | 10/2008 |
| DE | 10 2010 024 346 | A1 | 12/2011 |
| EP | 1 657 440 | A1 | 5/2006 |
| EP | 2 570 664 | A2 | 3/2013 |
| WO | WO 2007/054328 | A1 | 5/2007 |
| WO | WO 2008/030760 | A2 | 3/2008 |

OTHER PUBLICATIONS

Chinese-language Office Action issued in counterpart Chinese Application No. 201580062505.3 dated Jun. 4, 2018 with English translation (fourteen (14) pages).

International Search Report (PCT/ISA/210) issued in PCT Application No. PCT/EP2015/069580 dated Dec. 16, 2015 with English translation (five pages).

German-language Written Opinion (PCT/ISA/237) issued in PCT Application No. PCT/EP2015/069580 dated Dec. 16, 2015 (six pages).

German Office Action issued in counterpart German Application No. 10 2014 113 598.9 dated Jul. 2, 2015 (four pages).

* cited by examiner

MULTI-STAGE PISTON COMPRESSOR HAVING AN OUTER COOLING AIR CONDUCTION SYSTEM

CROSS REFERENCE TO RELATED APPLICATIONS

This application is a continuation of PCT International Application No. PCT/EP2015/069580, filed Aug. 27, 2015, which claims priority under 35 U.S.C. § 119 from German Patent Application No. 10 2014 113 598.9, filed Sep. 19, 2014, the entire disclosures of which are herein expressly incorporated by reference.

BACKGROUND AND SUMMARY OF THE INVENTION

The present invention relates to piston compressors, and in particular to cooling arrangements for such compressors.

The invention concerns a multi-stage piston compressor with a compressor unit having a plurality of air-cooled cylinders. The compressor crankshaft is housed in a crankcase and is driven by a motor unit that is flange-mounted on an end face on said compressor unit. On the opposing end face of the compressor unit is arranged a cooler unit, mounted on said compressor unit and driven by the crankshaft. An integrated axial fan wheel of said cooler unit blows cooling air substantially outward along the compressor unit. Moreover, the invention also concerns a rail vehicle with a compressed air system, especially a pneumatic brake system, which comprises such a multi-stage piston compressor for generating compressed air.

The area of application of the invention extends primarily to rail vehicle design. Rising environmental requirements in regard to pollution emission and noise protection are leading increasingly to the use of oil-free piston compressors in noise-encapsulated designs. Compressors for rail vehicles which run in residential regions or are parked there and held in readiness require an ever increasing expense on noise optimization of their equipment. With compressors in noise protection capsules, on the other hand, the problem of an adequate cooling of the compressor unit arises, because soundproofing materials generally also have good thermal insulation properties. Yet cooling problems do not occur only in such noise protection capsules, but also with installations in machine rooms or outdoor installations in the vicinity of heat sources, such as air conditioning units.

German patent documents no. DE 10 2010 024 346 A1 discloses a single-stage compressor unit in which the cooling air is generated by a radial fan, which is secured at the drive side of the compressor unit between the latter and the motor unit. In this technical solution, the cooling air is moved in the compressor's transverse direction and at the same time distributed among all cylinders. This requires a corresponding expense on components for the largely nested cooling air guidance.

Furthermore, single-stage or multi-stage piston compressors are also known from the general prior art in which the cooling air is blown from an axial fan directly onto the cylinders of the compressor unit. In order to prevent the cooling air from flowing off radially, a force guidance of the axially directed air flow is generated along the cylinders. Even so, a large portion of the cooling air of the axial fan is lost due to swirling caused by collisions with the cylinders.

Therefore, the problem which the present invention proposes to solve is to create an external cooling air guidance especially for a multi-stage piston compressor, which enables an efficient cooling of the cylinders of the compressor unit with slight expense on components.

The invention includes the technical teaching that, for the conducting of cooling air externally in the region of said compressor unit at least one air guide housing which extends at least partially radially around the crankcase in a curved manner is mounted on said cooler unit on the air inlet side and is mounted on the compressor unit crankcase on the air outlet side, such that the axially directed air flow which is generated by said axial fan wheel is at least partially taken in by the air guide housing and at least partially guided around the crankcase in the radial direction so as to reach at least one cylinder of the compressor unit arranged on the air outlet side of said air guide housing.

In other words, the external cooling air guidance according to the invention takes in the cooling air generated by the axial fan and deflects it by preferably around 90° from the axial direction to a radial direction about the crankcase, so that it then flows out against a cylinder of the compressor unit. Thus, the external cooling air guidance according to the invention directly adjoins the cooler unit and passes on the air flow generated by the axial fan wheel. Due to the curvature of the arc-shaped air guide housing, the air flow is deflected into a laminar flow for the efficient cooling of an air-cooled cylinder of the compressor unit which is outfitted with cooling ribs. Preferably, the cylinder arranged at the air outlet side of the air guide housing is matched up with a high-pressure stage of the preferably multi-stage compressor unit. Because of this the high-pressure stage of a multi-stage compressor unit is generally under greater thermal load than the upstream low-pressure stage. Furthermore, the high-pressure stage on account of the higher pressure is more temperature-sensitive in terms of wear on the component parts. Therefore, an efficient cooling of the high-pressure stage is especially important, and this is provided for by the solution according to the invention. An inadequate cooling, on the other hand, may lead to an intensified wear on component parts and thus a shorter service life or a premature compressor breakdown.

The improved cooling furthermore allows the piston compressor of the invention to be installed in so-called noise protection capsules, which provides a box-shaped receptacle for the piston compressor and its built-on parts and is lined with a soundproofing material. In this way, the noise output of the piston compressor is reduced and at the same time the temperatures at the compressor unit as well as the gas outlet temperatures are increased little if at all, or even lowered as compared to a non-encapsulated arrangement, thanks to the external cooling air guidance according to the invention. In addition, the invention is equally suited to installation at hot spots in a vehicle where the supply of cold cooling air is deficient, or generally for operation in hot climate zones of the Earth.

Preferably the air guide housing can extend in the radial direction around the crankcase of the compressor unit by a deflection angle of 90° to 360°. In one preferred embodiment, the air guide housing extends around the crankcase by around 90°. The compressor unit in this case is in a boxer design (i.e., having horizontally-opposed cylinders disposed on opposite sides of the crankshaft) and two air baffles are provided, being arranged opposite each other on the crankcase, each of them being matched up with one cylinder for the cooling. According to one preferred embodiment, the compressor unit comprises a total of three cylinders, two cylinders being matched up with a low-pressure stage and the remaining cylinder with a high-pressure stage. The cylinder of the high-pressure stage is preferably arranged next to the cooler unit, looking in the axial direction.

However, the cooling air guidance can also include the neighboring cylinder of the low-pressure stage and likewise cool it. The air guide housing is configured so that the cooling air flow moves around the entire fin position of the cylinder. Especially important in this case is the flow around the external cooling fins, i.e., the cooling fins close to the cylinder head. Of course, the cooling air guidance can also be used for the cooling of cylinders of single-stage compressors.

According to one measure which improves the invention it is proposed to arrange at least one fin for deflecting the cooling air in the radial direction at the inside of the wall of the air guide housing, extending radially in the direction of the crankcase. According to one preferred embodiment, two opposing fins which are spaced apart are arranged in the region of the cylinder being cooled on the air guide housing. The respective distal end of the fins can bear against the crankcase and thus define the distance between crankcase and air guide housing. The fins which are curved in the flow direction preferably lie vertically in the region of the upper and lower boundary of the cylinder being cooled according to the preferred embodiment. The fins take up the cooling air flow directed downward at a slant and deflect it horizontally toward the cylinder. Furthermore, the fins generate a back pressure in front of the cylinder being cooled, which increases the flow velocity in the region of the cooling fins of the cylinder, boosting the efficiency.

According to one preferred embodiment, the air guide housing at the air inlet side is configured such that it takes up the cooling air from the cooler unit through a radial region of 120° to 220°, preferably 180°. If two mutually opposing air guide housings are arranged on the crankcase in the context of a preferred embodiment—as described above—an uptake will occur preferably through a radial region of 180°. In this case, contact protection means are no longer necessary to cover the fan wheel, since it is entirely enclosed by the two air guide housings. Otherwise, appropriate contact protection means must be put in place in the areas of the cooler unit not contact-protected by the air guide housing.

According to one preferred embodiment of the air guide housing, the latter is a sheet metal design. The arc-shaped housing can be produced by rounding or edging the sheets. The air guide housing needs to be cut out in places requiring elastic mounting elements for the fastening of the piston compressor. According to one preferred embodiment, the air guide housing is multiple-piece, individual housing pieces being detachably joined together by a plug connection or by a screw connection. This improves the installation, accessibility, and servicing for purposes of cleaning the cooling fins.

However, it is also conceivable to have a single-piece air guide housing, preferably one made from injection-molded plastic. In this case, the fins serving for the air guidance can be easily molded on in the manufacturing process. Alternatively, the air guide housing can be cast at least partly from a light metal or the like.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
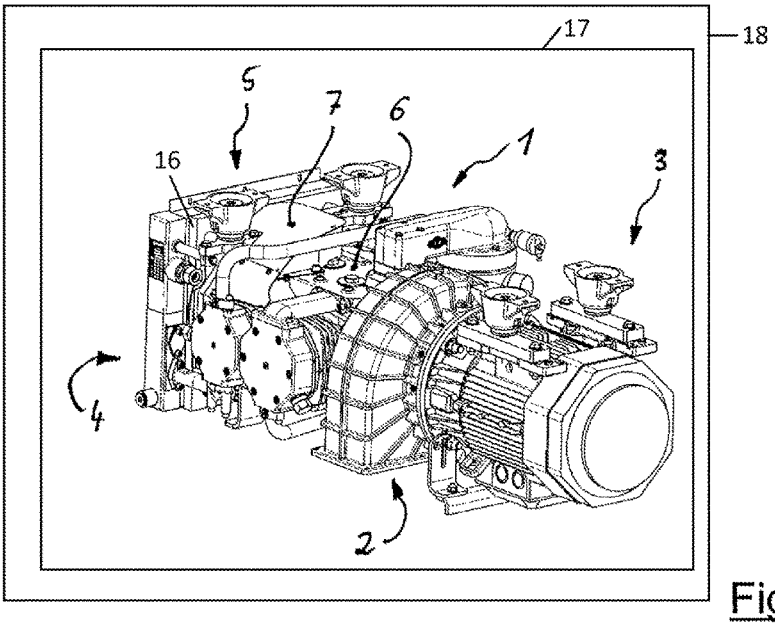
FIG. 1 is a perspective view of a multi-stage piston compressor with external cooling air guidance in accordance with an embodiment of the present invention.

According to FIG. 1, the multi-stage piston compressor consists substantially of a compressor unit 1, on whose first end face 2 is flange-mounted a motor unit 3 in the form of an electric motor, while on the opposite end face 4 there is arranged a cooler unit 5. The cooler unit 5 serves for cooling the compressed air flow, heated by compression inside the compressor unit 1, by an axial fan wheel 9 (see FIG. 2) for the generating of the cooling air, which flows outwardly along the compressor unit 1. For the external cooling air guidance in the region of the compressor unit 1, there is provided an arc-shaped air guide housing 7 extending partly radially around the crankcase 6. The compressor unit 1 is located in a noise protection capsule 17 on a rail vehicle 18.

Figure 2:
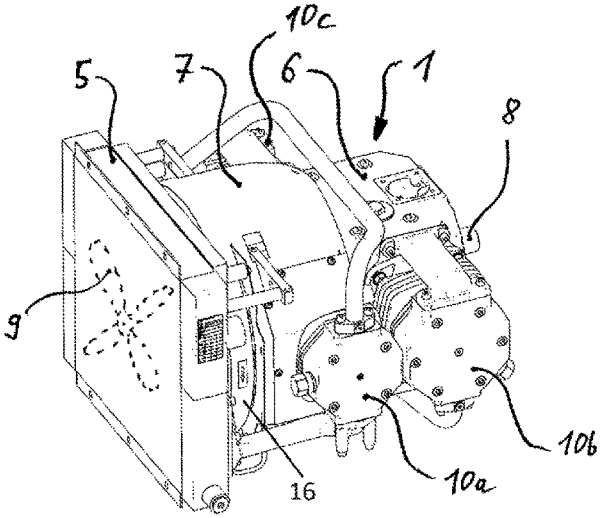
FIG. 2 is a perspective view of the compressor unit with cooler unit of the piston compressor of FIG. 1.

According to FIG. 2, a crankshaft 8 mounted rotationally in the crankcase 6 (here shown without the motor unit) drives the axial fan wheel 9 of the cooler unit 5, represented schematically by hidden body lines. The axial fan wheel 9 generates an air flow along the compressor unit 1, which is taken up by the air guide housing 7 (via axial fan wheel contact protection cover 16) at an angle of around 180°, guided in the radial direction partly around the crankcase 6, and taken at the air outlet side to a cylinder 10*a* of a high-pressure stage of the compressor unit 1 so as to cool at least the cylinder 10*a*. The cylinder 10*a* of the high-pressure stage of the compressor unit 1 is matched up with two cylinders 10*b* and 10*c* of an upstream low-pressure stage. In total, the air-cooled cylinders 10*a* to 10*c* form a boxer arrangement.

Figure 3:
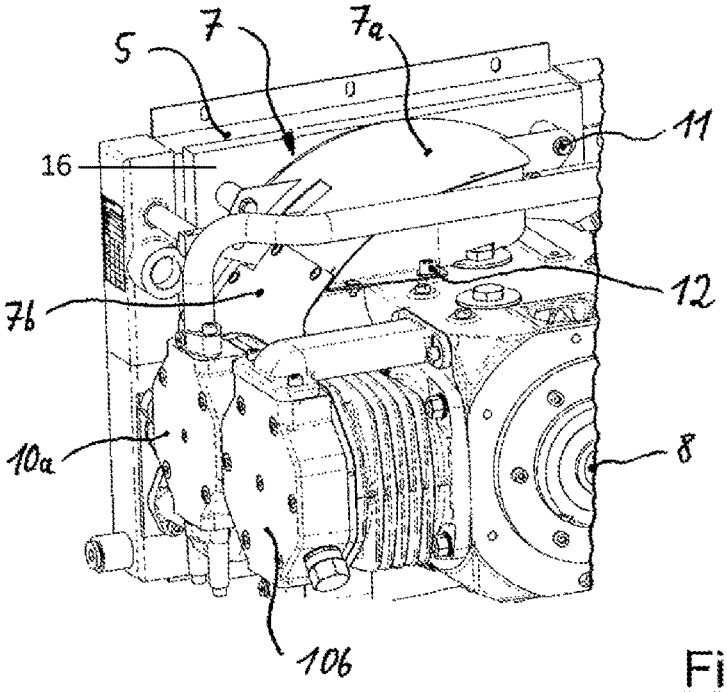
FIG. 3 is a perspective view of the compressor unit with cooler unit of the piston compressor of FIG. 1 in a different viewing direction than that of FIG. 2.

In FIG. 3, the air guide housing 7 is secured at the air inlet side to the cooler unit 5 by screws 11 (for example) along a radial region of around 180°. Furthermore, the air guide housing 7 is secured by further screws 12 (for example) at the side with the crankcase 6. For purposes of a simple disassembly, the air guide housing 7 is a multiple-piece design and consists of a first housing piece 7*a* and a second housing piece 7*b*, which are detachably joined together here by various screw connections. The air guide housing 7 consists of bent and edged sheet metal sections, in order to guide the cooling air flow emerging from the cooler unit 5 on the air inlet side with the fewest possible losses to the cylinder 10*a*.

Figure 4:
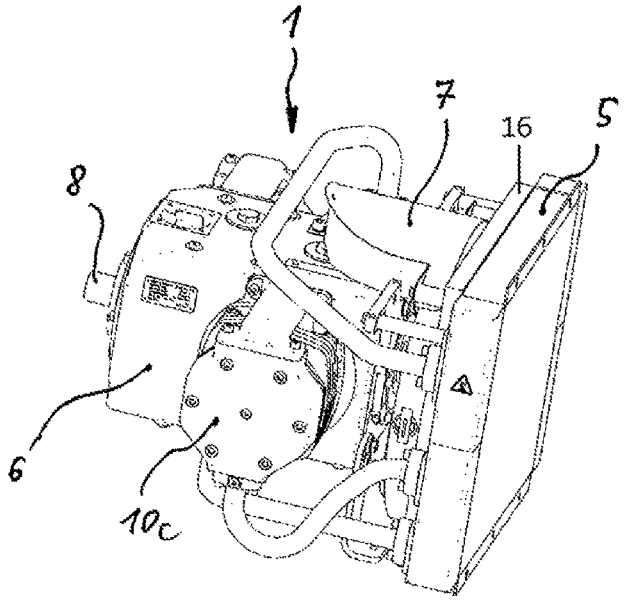
FIG. 4 is a perspective view of the compressor unit of FIG. 1 with cooler unit of the piston compressor in a different viewing direction than that of FIG. 3.

FIG. 4 shows the opposite side of the crankcase 6 from that of FIG. 3, on which the second cylinder 10*c* of the low-pressure stage is arranged.

Figure 5:
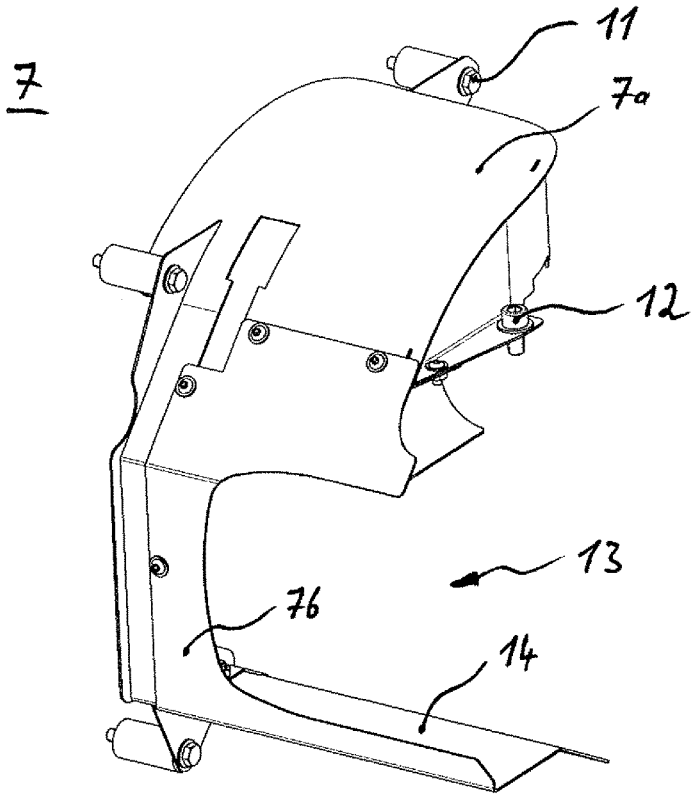
FIG. 5 is a perspective view of the air guide housing of FIG. 1 in a first viewing direction.

Per FIG. 5, the assembled air guide housing 7 includes the first housing piece 7*a* and the second housing piece 7*b*, which are detachably joined together by screw connections. The cylinder 10*a* protrudes through a recess 13. The second housing piece 7*b* encloses the cylinder 10*a* substantially in a U-shape and in particular also underneath the onflow side, along an elongated transverse section 14.

Figure 6:
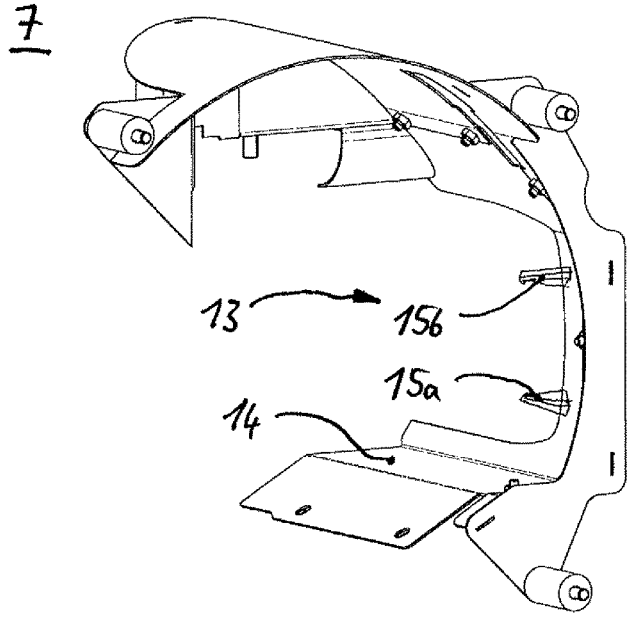
FIG. 6 is a perspective view of the air guide housing of FIG. 1 in a second viewing direction.

In FIG. 6, two mutually opposing and spaced apart fins 15*a* and 15*b* are arranged at the inside of the air guide housing 7, being arranged in the region of the cylinder 10*a* being cooled on the air guide housing 7. The two fins 15*a* and 15*b* serve to deflect the cooling air flow from the axial direction to the radial direction to cool the cylinder 10*a*. The radial cooling air guidance occurring in this region assumes the form of the axial fan 9 on the side with the compressor unit 1 and prevents a sideways outflow of the cooling air, which is thereby deflected in the direction toward the cylinders. The tub geometry of the air guide housing 7 takes the cooling air through the transverse section 14 underneath the cylinder 10*a* to the lower edge of the neighboring cylinder 10*b*, which is also secondarily cooled in this way.

Figure 7:
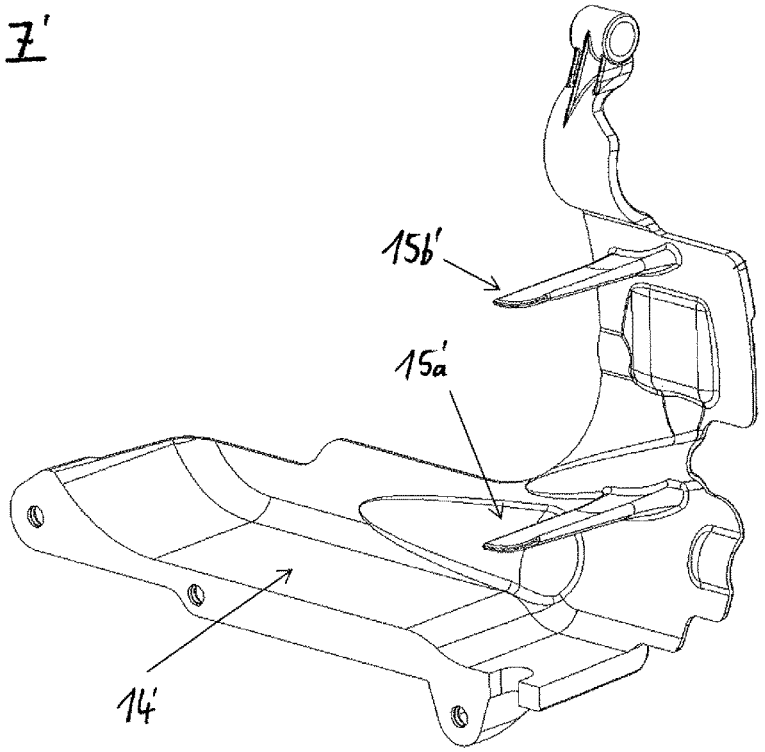
FIG. 7 is a perspective view of an air guide housing in an alternative embodiment according to the present invention.

The alternative embodiment of an air guide housing 7' shown in FIG. 7 is an injection-molded plastic piece, on which the fins 15*a*' and 15*b*' are directly molded. Thanks to the transverse section 14', likewise molded on, cooling air is also taken underneath the cylinder to the neighboring cylinder so as to cool that as well.

The invention is not limited to the above-described preferred sample embodiment. Instead, many modifications are conceivable that are also included in the protection scope of the following claims. Thus, for example, it is also possible to design a single-cylinder compressor unit with the external cooling air guidance according to the invention. The cooling air guidance is especially suitable for installing the compact-design piston compressor described here inside a box-shaped noise protection capsule, in order to accomplish a sufficient cooling of the piston compressor despite the soundproofing produced by the encapsulation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SYMBOLS

1 compressor unit
2 first end face
3 motor unit
4 second end face
5 cooler unit
6 crankcase
7 air guide housing
8 crankshaft
9 axial fan wheel
10 cylinder
11 screw
12 screw
13 recess
14 transverse section
15 fin
16 axial fan wheel contact protection cover
17 noise protection capsule
18 rail vehicle

What is claimed is:

1. A multi-stage piston compressor, comprising:

a compressor unit having at least one air-cooled cylinder and a crankshaft housed in a crankcase, the compressor being unit being arranged to be driven by a motor unit mounted at an end face of the compressor unit;

a cooler unit mounted at an opposite side of the compressor unit and arranged to be driven by the crankshaft, the cooler unit including an axial fan wheel arranged to generate a flow of cooling air toward the compressor unit; and at least one air guide housing adjacent to a compressor unit-side of the cooling unit, the at least one air guide housing being configured to extend at least partially radially around the crankcase in a curved manner such that an axial air flow generated by the axial fan wheel is at least partially guided by the air guide housing around in a radial direction and to at least a first cylinder of the at least one cylinder at an air outlet side of the at least one air guide housing, wherein the at least one air guide housing includes at least one fin arrangement at an inside of the wall of the at least one air guide housing and extending radially inward toward the crankcase, the at least one fin being configured to deflect the flow of cooling air deflected in the radial direction toward the first cylinder, and the at least one fin includes two fins spaced apart in a region of the at least one air guided housing adjacent to the first cylinder.

2. The multi-stage piston compressor as claimed in claim 1, wherein the at least one cylinder is a plurality of cylinders, and the first cylinder is a high-pressure stage of the compressor unit.

3. The multi-stage piston compressor as claimed in claim 1, wherein the air guide housing extends in the radial direction around the crankcase of the compressor unit by a deflection angle of 90° to 360°.

4. The multi-stage piston compressor as claimed in claim 1, wherein the at least one air guide housing at an air inlet side adjacent to the cooler unit receives the flow of cooling air generated by the axial fan wheel through a radial region of 120° to 220°.

5. The multi-stage piston compressor as claimed in claim 4, wherein the radial region is 180°.

6. The multi-stage piston compressor as claimed in claim 1, wherein the at least one air guide housing is formed from sheet metal.

7. The multi-stage piston compressor as claimed in claim 1, wherein the at least one air guide housing is a multiple-piece housing, the multiple-piece housing including at least two housing pieces configured to be detachably joined together by a plug connection or by at least one fastener.

8. The multi-stage piston compressor as claimed in claim 1, wherein an axial fan wheel contact protection cover is arranged between the cooler unit and the at least one air guide housing.

9. The multi-stage piston compressor as claimed in claim 1, wherein the at least one air guide housing is arranged to provide axial fan wheel contact protection over at least a portion of a circumference of the axial fan wheel.

10. The multi-stage piston compressor as claimed in claim 1, wherein the at least one air guiding element includes two air guiding elements arranged opposite each other at the crankcase of the compressor unit, and each of the two air guiding elements guides a respective portion of flow of cooling air generated by the axial fan wheel to a respective one of the at least one cylinder.

11. The multi-stage piston compressor as claimed in claim 1, wherein the at least one cylinder includes three cylinders arranged in a horizontally-opposed configuration on opposite sides of the crankshaft.

12. A rail vehicle with a compressed air system, comprising the multi-stage piston compressor as claimed in claim 1; and a noise protection capsule enclosing the multi-stage piston compressor, the noise protection capsule being lined with soundproofing material.

* * * * *